US005984153A

United States Patent [19]

Richard

[11] Patent Number: 5,984,153

[45] Date of Patent: Nov. 16, 1999

[54] DEVICE AND PROCESS FOR CHANGING A CONTINUOUS CASTING TUBE OF A DISTRIBUTOR OF A STEEL MILL

[75] Inventor: Francois Noel Richard, Nancy, France

[73] Assignee: Vesuvius France, Feignies, France

[21] Appl. No.: 08/945,557

[22] PCT Filed: Apr. 15, 1996

[86] PCT No.: PCT/FR96/00572

§ 371 Date: Feb. 24, 1998

§ 102(e) Date: Feb. 24, 1998

[87] PCT Pub. No.: WO96/34713

PCT Pub. Date: Nov. 7, 1996

[30] Foreign Application Priority Data

May 5, 1995 [FR] France ..... 95 05504

[51] Int. Cl.[6] ..... B22D 41/08

[52] U.S. Cl. ..... 222/590; 222/606; 266/236; 266/44

[58] Field of Search ..... 266/236, 44; 222/590, 222/591, 606, 607

[56] References Cited

U.S. PATENT DOCUMENTS

| | | | |
|---|---|---|---|
| 3,907,022 | 9/1975 | Simons et al. . | |
| 4,344,550 | 8/1982 | Szadkowski | 222/600 |
| 4,568,007 | 2/1986 | Fishler | 222/606 |
| 4,669,528 | 6/1987 | Szadkowski . | |
| 5,114,123 | 5/1992 | Pfyl | 266/236 |
| 5,693,249 | 12/1997 | Szadkowski | 222/590 |

FOREIGN PATENT DOCUMENTS

| | | |
|---|---|---|
| 0 192 019 | 8/1986 | European Pat. Off. . |
| 0 442 515 | 8/1991 | European Pat. Off. . |
| 2064123 | 7/1971 | France . |
| 2065592 | 7/1971 | France . |
| 20 27 881 | 12/1979 | Germany . |
| WO 95/03906 | 2/1995 | WIPO . |

*Primary Examiner*—Scott Kastler

*Attorney, Agent, or Firm*—Sixbey Friedman Leedom & Ferguson; Thomas W. Cole

[57] ABSTRACT

A tube changing device is comprised of a chassis (16) mounted of the distributor (2), refractory pieces (10, 18, 22) that delimit a casting gutter, these refractory pieces being comprised of at least one fixed place (18) and a tube having a plate (24) in its upper part, means for generating pressure for applying the plate (24) of the tube (22) against the fixed plate (18), a position for introducing a new tube (22*a*), a casting position and a position for evacuating the worn tube (22*b*), guidance means (18, 48) that permit the new tube (22*a*) to pass from the introduction position to the casting position and the worn tube (22) to pass from the casting position to the evacuation position, actuation means (34, 36) for moving the new tube from the introduction position to the casting position and the worn tube from the casting position to the evacuation position. The introduction position, casting position and evacuation position are arranged around a convex cylindrical surface (18) that constitutes the periphery of the fixed plate.

34 Claims, 3 Drawing Sheets

DEVICE AND PROCESS FOR CHANGING A CONTINUOUS CASTING TUBE OF A DISTRIBUTOR OF A STEEL MILL

The present invention concerns a device for changing a continuous casting tube, comprised of:

a chassis mounted on the distributor;

refractory pieces that delimit a casting channel for passage of the steel from the distributor to a continuous casting mold having a large dimension and a small dimension, these refractory pieces being comprised of at least one fixed plate and a tube having a plate in its upper part;

pressurizing means for applying the plate of the tube against the fixed plate;

a position of introduction of a new tube, a casting position and an evacuation position for a worn tube;

guiding means that permit the new tube to pass from the introduction position to the casting position and the worn tube to pass from the casting position to the evacuation position;

actuating means for making the new tube pass from the introduction position to the casting position and the worn tube from the casting position to the evacuation position.

It is generally applied to the casting of slabs and more particularly to the casting of thin slabs.

In a steel mill continuous casting installation the steel is poured from a ladle into a distributor and from the distributor into one or more molds. To protect the steel from contact with air between the distributor and the mold, the steel is isolated from the atmosphere by means of an immersed refractory tube fixed at the bottom of the distributor and the lower end of which dips into the mold.

This tube wears and becomes clogged rapidly, more particularly in its lower section.

This limits the duration of the casting. To prolong this time, devices has been conceived that permit replacing a worn tube with a new tube. For economic reasons, it is preferable to change the tube without interrupting the casting, i-e, without raising the distributor.

In these devices, called tube-changing devices, the tube is provided with a plate in its upper part; this plate can be attached or formed of a single piece with the tube. This plate can slide, while maintaining a tight joint, on the lower face of a fixed plate of the distributor. The entire assembly of the tube and plate associated with it are simply called the tube in the following. A new tube is introduced into the ingot mold, alongside the worn tube. Means permit pushing the new tube into the casting position while the worn tube is pushed to the other side of the mold.

To permit a tube change without raising the distributor, the lower end of the new tube has to be immersed in the steel of the mold before the worn tube is pushed toward its evacuation position. In the same manner, the worn tube remains immersed in the steel when it is in the evacuation position.

An example of such a device is known from the document EP 0 192 019.

These familiar devices have several shortcomings.

It is necessary for the mold to be of sufficient width so that three tubes can be placed there side-by-side: the position of the new tube, the position of the tube that is in the process of casting, and the position that the worn tube will assume after exchange. In numerous cases, the mold does not have a sufficient width and other less favorable processes have to be used.

To make the tube change, a jack that pushes the new tube to the level of its plate, which rests on the plate of the worn tube, is generally used. It is indispensable for this effort to be transmitted via the plates of the new tube and the worn tube. In other words, it is indispensable that these plates come in contact with each other before the lower ends of the tubes touch. In fact in the contrary case, the forces exerted at the end of the tubes would cause them to jam in the sliding surfaces of tube change and rupture. For the device to function correctly, it is thus necessary that the plates have a length greater than the space required for the end of the tubes in the direction of the large dimension of the mold. This requirement is easy to meet in the case of a thick slab. In fact, the tube then has an approximately circular compact section and the plate can easily present a length greater than the outside diameter of the tube. On the other hand, in the case of a thin slab casting the mold is very narrow. In order to preserve a substantial passage section, the end of the tube should be quite prolonged in the direction of the large dimension of the mold. Consequently, the plates provided at the upper end of the tube should themselves be quite prolonged. Besides a supplementary cost, this results in an increase in their space requirement and the difficulties involved in maneuvering the tube in the reduced volume between the bottom of the distributor and the mold.

To alleviate this shortcoming, the idea was conceived to introduce an intercalary plate between the plates of the tubes. Such an arrangement is described in the patent W095/03906, for example. This intercalary plate effectively permits reducing the dimension of the plates, but it requires supplementary manipulations, presents the risk of forgetting the intermediate plate and poses alignment problems.

Finally, during the placement of the tube, its end has to be introduced into the mold and then plunged into the steel. In the same manner, during extraction of the worn tube, the lower end of the tube has to be extracted from the steel and then the mold.

In the prior art, these procedures are generally carried out manually by an operator who carries and directs the tube by means of a pliers, possibly associated with supports designed to facilitate the operations. In the case of thick slabs, these manual procedures are relatively easy because there is several centimeters of play between the tube and the edges of the mold and because the skin of solidified steel on the wall of the mold is thick and strong and can easily tolerate possible shocks with the tube due to manipulation by hand. In the case of thin slabs, the problem of handling becomes critical because the play between the tube and the walls of the mold is reduced to a few millimeters and the skin solidified in this type of thin slab is quite thin and fragile. The contact of the tube with this skin would involve the substantial risk of breaking the skin, which would cause a break in the ingot mold and stop the casting. The manipulations should thus be extremely precise if one does not wish to strike the tube.

A manual manipulation is consequently unrealistic. It would accordingly be necessary to use one or several very precise manipulators both for the introduction and the removal of the tube. Such manipulators would not only be very expensive but also difficult to position in the working zone which is small and has to remain accessible to operators. The present invention precisely concerns a tube changer device which remedies these shortcomings.

According to the main feature of the invention, the introduction position, the casting position and the evacuation position are arranged around a convex cylindrical surface that has an axis perpendicular to the large dimension of the mold, this cylindrical surface constituting the periphery of the fixed plate.

The plate of the tube has a concave cylindrical form that is adapted to the convex cylindrical surface of the fixed plate in order to maintain a tight joint between these surfaces during passage of the new tube from the introduction position to the casting position and the passage of the worn tube from the casting position to the evacuation position by a rotation movement around the axis of the cylindrical plate.

The fixed plate is advantageously located as low as possible above the mold so that the circle that is described by the of the tubes during their rotation is as small as possible. Thanks to this feature, the device may be used even when the width of the mold is smaller than three times the length of the end of the tube. In effect, since the introduction of the new tube and the removal of the worn tube are effected by a rotational movement, it is sufficient that the space circle described by the end of the tube does not hit the edge of the mold. A tube change can then be effected even in a narrow mold without having to raise the distributor. It may be that when the width of the mold is reduced, it is possible to raise the distributor slightly so that the space circle of the tube avoids the edges of the mold while keeping the tube immersed in the casting position.

The tube plate can easily be much smaller than the end of the tube. In fact, the radius of the cylindrical surface is much less than the radius of the circle described by the end of the tube. Consequently, it is sufficient that the ratio of the length of the plate to the length of the tube end be in the same ratio as the radius of the cylindrical surface to the circle traversed by the end of the tube.

Finally and principally, the new tube is entirely outside of the steel and even generally outside of the mold when it is in its introduction position and the worn tube is entirely outside of the steel, and even generally outside of the mold when it is in its evacuation position.

Due to preferred characteristic, during the introduction of a new tube and the evacuation of a worn tube, the tube is guided by the tube changing device itself. This guidance is by rotation induced by the cylindrical surface of the fixed plate on which the concave surface of the tube plate slides. The device also furnishes a lateral guidance of the tube in the mold. These two guidances are very easily precise. The quite substantial handling problem is thus eliminated and the need for resorting to a costly manipulator that is difficult to operate is suppressed.

The invention also concerns a process for changing the tube of the continuous casting distributor in a steel mill for replacement of a worn tube with a new tube, in which a new tube is placed in a tube changing device, then pushed into the casting position while at the same time the worn tube is pushed from the casting position to an evacuation position.

The process is characterized in that the new tube is placed in the tube changing device in a position located outside the mold, that the new tube is brought into its casting position by a rotation around a horizontal axis perpendicular to the large dimension of the mold, which has the effect of rotating the worn tube around this same axis, bringing the worn tube into an evacuation position outside of the mold in place, the center of rotation being as low as possible.

Under difficult circumstances, when the width of the mold is particularly reduced, the distributor is raised sufficiently so that the circle that will be described by the end of the new tube during its rotation avoids the edge of the mold, without the tube that is in the process of casting ceasing to be immersed in the liquid steel of the mold;

the new tube is placed in the tube changing device;

the worn tube is brought into its casting position by a rotation that causes a rotation of the worn tube around this same axis;

the worn tube is extracted from the tube changing device;

the distributor is lowered to its normal casting position.

This process permits a tube change when the mold has a reduced width without having to interrupt the casting.

According to a preferred variant of the invention process, the new tube is placed in the tube changing device in an essentially horizontal position, the new tube is brought into its casting position by an essentially 90° rotation around a horizontal axis, which has the effect of causing the worn tube to rotate essentially 90° around this same axis and the used or worn tube is extracted from the tube changing device in an essentially horizontal position.

The actuation means are preferably comprised of a rotor mounted rotatably around the horizontal axis of the cylindrical surface; this rotor is comprised of a finger that pushes the new tube under the means of applying pressure.

The finger preferably effects a back-and-forth movement for taking up a new tube.

The device preferably has first holding means that permit maintaining the new tube in its introduction position and second holding means that permit maintaining the worn tube in its evacuation position.

The guidance means and the holding means are preferably designed to permit the introduction of the new tube and evacuation of the worn tube in a direction perpendicular to the large dimension of the mold.

The means for applying pressure to the plate preferably transmit radial forces to the back of the plate.

The edges of the plates are preferably designed to assure a contiguous contact so that no interstice is left between two successive plates during passage of the joint opposite the casting orifice.

The cylindrical plate preferably has means of blocking rotation with respect to the chassis.

Other characteristics and advantages of the present invention will appear from reading the following description of an implementation example given by means of illustration with reference to the attached figures.

Figure 1:
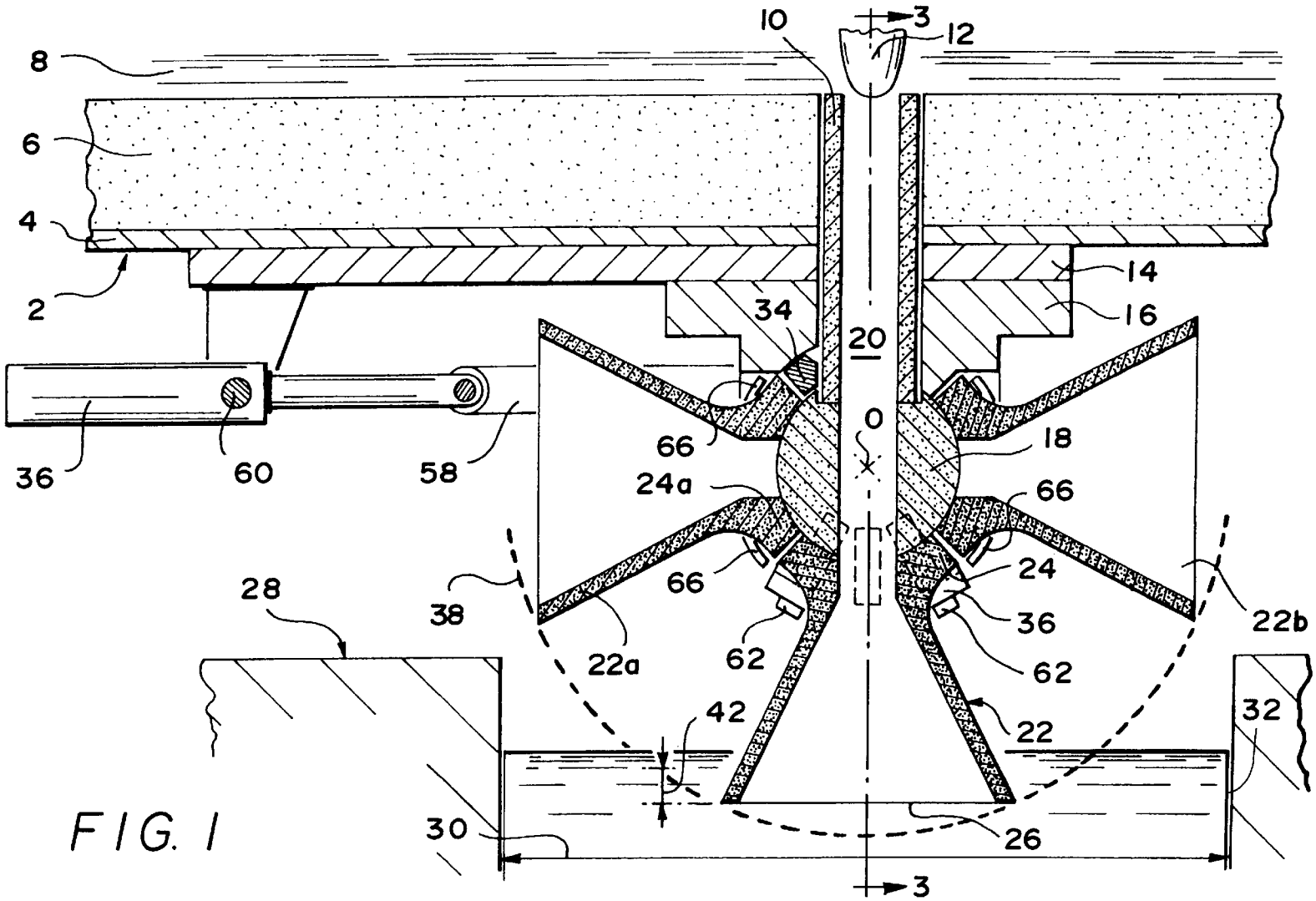
FIG. 1 is a view in longitudinal cross section of a tube changing device according to the present invention.

The distributor designated by the general reference 2 was shown only partially. It is comprised of a bottom wall of steel 4 covered with a layer of refractory material 6. It contains the molten steel 8. The bottom of the distributor 2 is traversed by an internal nozzle 10 that permits passage of the molten steel 8. The steel flux passing through the internal nozzle 10 can be controlled by a stopper rod 12 or possibly by a slide device intercalated between the bottom of the distributor and the tube change (device not shown).

A fixation or base plate 13 is fixed under the bottom plate 4 of the distributor. The chassis or underframe 16 of the tube changing device according to the invention is fixed under the base plate 14. A fixed plate 18 is mounted in the chassis 16. This fixed plate is a cylinder of refractory material having in its upper part a nesting joint 19 that permits receiving the lower end of the internal nozzle 10. The fixed plate is traversed by an orifice 20 that prolongs the channel of the internal nozzle 10. The center of the fixed plate 18 was designated by the letter 0. A tube designated by 22 is mounted in the lower part of the fixed plate 18. The tube 22 has in its upper part a concave plate 24 that is applied tightly on the fixed plate 18. Means of applying pressure 36 are provided for applying the plate 24 of the tube 22 against the fixed plate 18.

The length of the lower end of the tube is designated by 26.

The casting mold 28 is located underneath the tube changing device; it has a large dimension designated by 30 and is generally called the width. The mold contains the molten steel 8, still in the liquid state, and solidified only in contact with the mold walls, which are cooled with water, to form a skin 32.

In FIG. 1, a second tube, designated by 22*a*, was placed on the cylindrical surface 18. The tube 22*a* is a new tube for replacing the tube 22. For this purpose, the invention provides means of actuation for moving the new tube 22*a* from its introduction position shown in FIG. 1 to the casting position, which is that of tube 22 and for simultaneously moving the tube 22 from the casting position to the evacuation position 22*b*. In the implementation example shown the actuating means are comprised of a transverse bar 34 applied against the upper edge of the plate 24*a* of the new tube. The bar 34 is connected to the rotor 48, which is capable of turning on the same axis as the fixed plate. The actuation means also involve a jack 36 mounted under the base plate 14, which permits actuating the bar 34.

Figure 2:
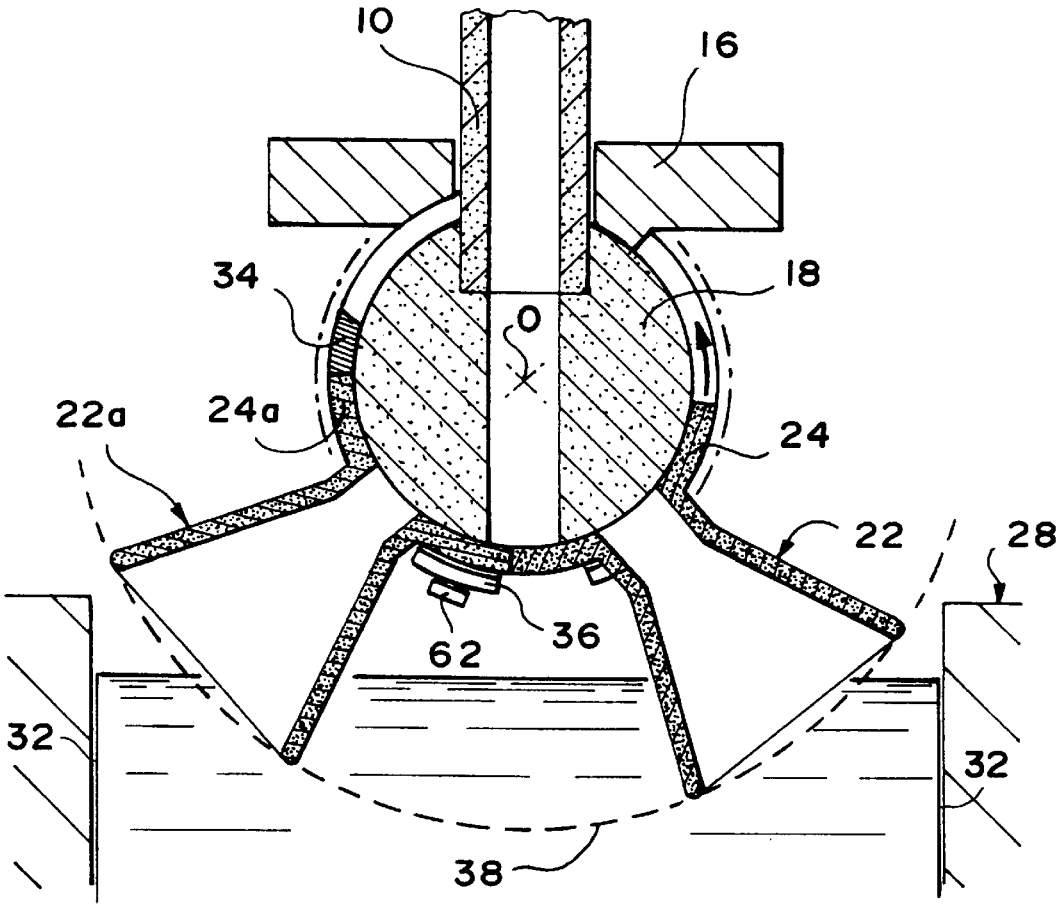
FIG. 2 is a schematic view in longitudinal section that illustrates the position of the device during a tube change.
Figure 3:
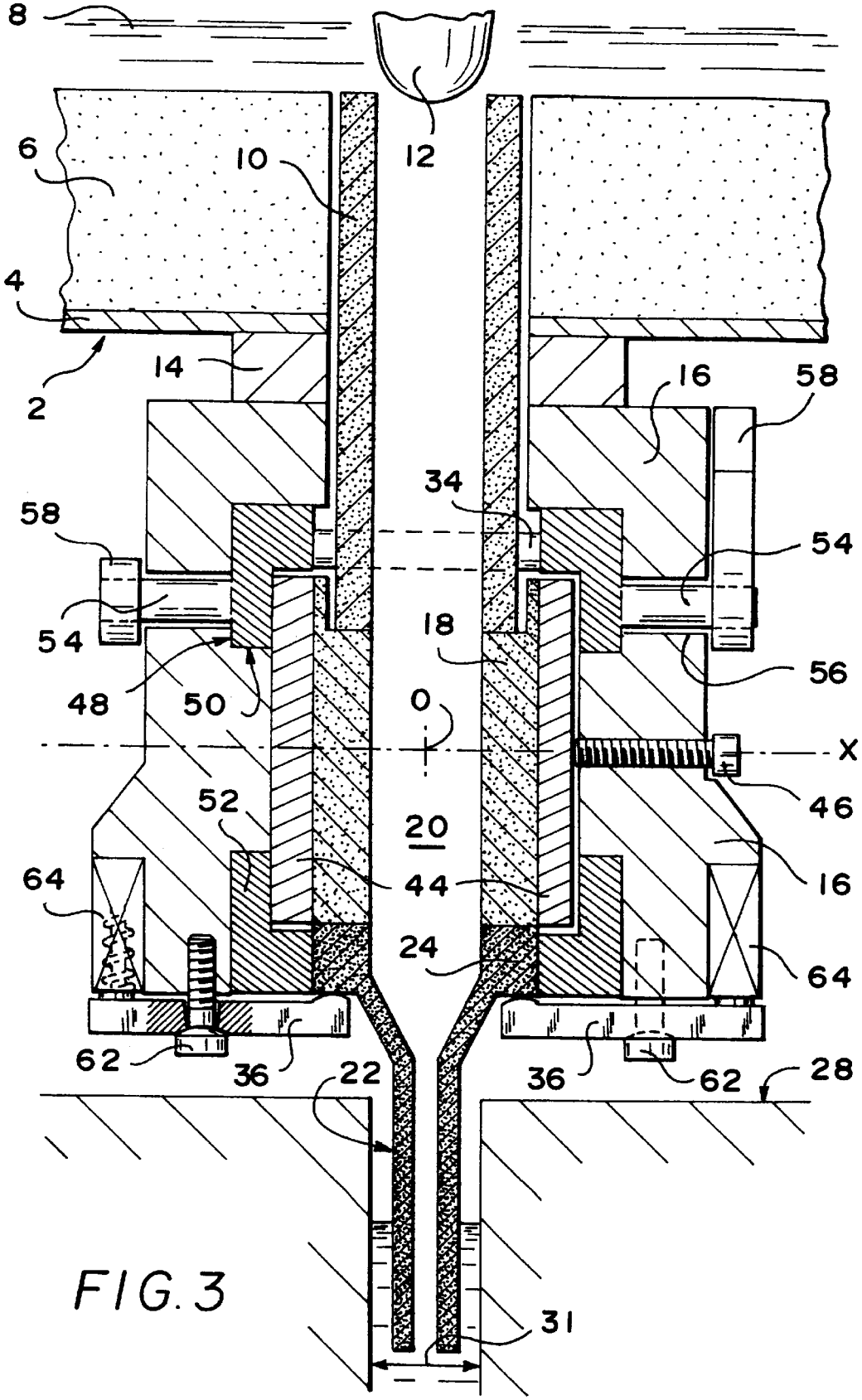
FIG. 3 is a cross sectional view along line 3—3 of FIG. 1.

FIG. 2 shows the new tube 22*a* and the worn tube 22 during change. It can be seen that the lower end of the new tube 22*a*, which was entirely out of the molten steel 8 of the mold, and even entirely out of the mold 28 in its introduction position as shown in FIG. 1, is immersed in the steel only when the tube is placed in the casting position. In the introduction position 22*a* and in the evacuation position 22*b* the tube is applied without being pressed against the cylindrical surface 18. Pressure is progressively applied when it passes from the introduction position 22*a* to the casting position. The pressure is also progressively released when the tube passes from the casting position to the evacuation position 22*b*. The plate 24*a* of the new tube penetrates under upenders 36 that have one end actuated by an elastic means such as springs, for example, and another end, visible on FIG. 2, adapted to the back of the plate 24, 24*a* of the tube. The end of the upender 36 exerts a radial action on the plates 24, 24*a* and 24*b* of the tubes, in other words, an action directed preferentially toward the center 0 of the fixed plate 18. It is thus evident that the tube changing device of the invention, as a device of the prior art, provides three positions, i-e, a position for introducing a new tube, a casting position and a position for evacuating a worn tube. However, in contrast to the prior art, when the tubes are arranged in these respective positions, they are not mutually parallel, but arranged radially on the fixed plate 18. As can be seen in FIG. 2, the worn tube 22 has already partially left the mold when the new tube 22*a* penetrates into it. To facilitate the operation of the device, it is sufficient that the circle of avoidance 38 described by the point of tubes 22, 22*a* and 22*b* the farthest from the center 0 of the fixed plate 18 does not run into the angle 40 of the casting mold 28. In the case where the circle 38 would strike the angles 40 it would still be possible to raise the distributor slightly by a distance 42 (see FIG. 1) such that the tube 22 still remains submerged in the molten steel 8 of the mold. By raising the distributor, the center 0 of the fixed plate 18 is raised and consequently the position of the avoidance circle 38. FIG. 3 shows a cross sectional view of the tube changing device of the invention. The cylindrical plate 18 is held between two plates of insulating refractory material 44 that can be an integral part of the plate 18. The plates 44 may have a metal envelope on their outer face, perhaps on both faces. A screw 46 or any other blocking means permits holding the two plates 44 and the cylindrical plate 18 applied against the frame 16. A rotor 48 is rotatably mounted on cylindrical bearing surfaces 50 of the frame 16. The rotor 48 is comprised of two side plates 52 connected with each other by the transverse bar 34 forming the pushing finger that actuates the new tube during its placement. In the configuration illustrated by the example, each side place 52 is provided with a rod 54 that passes through a beanshaped hole 56 in the frame 16. The two fingers 54 are connected to a carrying fork 58, itself solid with the rod of the jack 36. The jack 36 is a dual-action one. It draws and pushes the fork 58 to give the finger 34 a back-and-forth rotary movement. During this movement, the two axes 54 describe a ca. 90° arc of circle around the axis X—X of the cylindrical piece 18. This is the reason why the jack 36 is articulated relative to the base plate around an axis 60 so as to permit its angular clearance. It will be noted that the orifice 20 that passes through the cylindrical plate 18 can be cylindrical, as in the implementation example shown, but it can also have a section that flares out. In this case, the casting gutter at the entrance to the tube 22 has a corresponding flared form in order to maintain the continuity of the section of casting gutter.

On the other hand, means are provided for immobilizing the cylindrical plate 18 rotatably relative to the frame 16. In fact, it is subject to relatively substantial rotational forces exerted by the frictional forces of the plates 24 of the tubes during their rotation.

FIG. 3 shows an example of implementing the means for applying pressure to the plates 24, and the tubes such as 22. These means are comprised of upenders 36 articulated at their central part on screws 62 with a spherical head and mounted in the frame 16. At their outer end the upenders 36 are pushed by springs 64. At their lower end, which may have a concave form that is adapted to the outer face of the plates 24, the upenders 36 exert a radial action directed toward the X-X axis of the cylindrical plate 18. At least one pair of upenders is provided, preferably several pairs, in order to assure an application force distributed along the plate 24.

The side plates 52 of the rotor 48 advantageously have a diameter greater than that of the fixed plate 18 to serve as lateral guidance for the tube. One of the side plates 52 of the rotor 48 has two indentations, i-e, an indentation for introducing the new tube and an indentation for evacuating the worn tube. These indentations are designed to permit the introduction of the new tube and the extraction of the worn tube through the face of the mold, in other words, to permit introducing it into the introduction position and extracting it from the evacuation position by displacing it in a direction perpendicular to the large dimension 30 of the mold (see FIG. 1) (parallel to the axis of the cylinder).

Retention means are provided to maintain the new tube 22*a* in its introduction position. These means are comprised of a dished plate 66 located on one side of the frame. On the other side of the frame only one lug or catch placed at the lower position of the tube is provided to permit its introduction. Identical retention means are provided in the evacuation zone to hold the worn tube in the extraction position.

This device operates as follows. When a tube change is desirable, the tube that is in the casting position being worn or plugged, one begins by introducing a new tube 22*a* into the introduction position, shown on the left in FIG. 1. At this moment the actuating finger 34 is situated in the upper part of the fixed plate 18, in the proximity of the internal nozzle 10. The introduction of the new tube 22*a* can be made, as in the implementation example described, along the front face of the mold, which permits an easy manipulation of the tube. But it is also possible to envision, in an implementation variant, the introduction of the new tube along another direction, e.g., radial relative to the fixed plate. It is then necessary to provide retaining means adapted to this new direction. With the new tube 22*a* in place in the retaining means, the jack 36 is actuated and its exerts a tractive force on the fork 58, 54 from right to left according to FIG. 1 to make the rotor 48 rotate in the counterclockwise direction. It should be noted that the fork 58 distributes the force of the jack on the two axes 54 so that the forces are symmetric. The actuating finger 34 pushes the plate 24*a* of the new tube 22*a*. This plate 24*a* is advantageously tight with the plate of the worn tube 22 so that there is no space between them that permits passage of the molten steel. It is possible to close off the casting gutter beforehand by means of the stopper rod 12. Taking into account the absence of space between the plates, it is also possible to effect a tube change without closing the casting gutter.

When the worn tube 22 reaches the evacuation position 22*b*, the new tube 22*a* replaces it and pouring of the metal can continue normally. All the time needed is available for removing the worn tube 22*b*, which is held in the holding means that were described previously. The jack 36 is then actuated in the other direction in order to return the finger 34 to its initial position. The cycle can then begin again for a new tube change.

I claim:

1. A refractory tube for use in the continuous casting of steel comprising a tube having a first end, a second end, a throughbore opening extending from the first end to the second end, and a tube plate surrounding the first end of the tube, the tube plate having a concave cylindrical surface for mating with and slidably moving around a convex cylindrical periphery only in a single plane.

2. A refractory plate for use in the continuous casting of steel comprising a continuous convex cylindrical sliding surface and a casting orifice having an outlet end disposed in and surrounded by said contiuous convex cylindrical sliding surface.

3. Refractory pieces for use in the continuous casting of steel that delimit a casting channel for the passage of the steel comprising:

(a) a refractory tube having a first end, a second end, a throughbore opening extending from the first end to the second end, and a tube plate surrounding the first end of the tube, the tube plate having a concave cylindrical surface, and (b) refractory plate having a convex cylindrical periphery slidably mating with the tube plate and a casting orifice aligned with the throughbore opening.

4. Tube changing device for continuously casting steel from a distributor into a mold having a long dimension comprising:

a chassis mounted on the distributor;

at least one fixed plate depending from the chassis and having a casting orifice, a convex cylindrical periphery and a horizontal axis perpendicular to the long dimension of the mold and parallel to the cylindrical periphery;

a tube having a first end, a second end, a throughbore opening between the first and second ends, the first end surrounded by a tube plate, the tube plate having a concave cylindrical surface tightly yet slidably mated to the periphery of the fixed plate so that when the throughbore opening is aligned with the casting orifice a casting channel is defined for the passage of steel from the distributor to the mold;

three tube positions arranged around the horizontal axis of the fixed plate comprising an introduction position, a casting position, and an evacuation position, whereby the tube is rotated around the horizontal axis of the fixed plate while moving between the introduction position, casting position and evacuation position;

pressurizing means for pressing the tube plate against the fixed plate;

guidance means to direct the tube from the introduction position to the casting position and from the casting position to the evacuation position; and actuating means for moving the tube from the introduction position to the casting position and from the casting position to the evacuation position.

5. The tube changing device of claim 4, wherein the tube is completely out of the steel in the mold when in the introduction position.

6. The tube changing device of claim 4, wherein the tube is completely out of the steel in the mold when in the evacuation position.

7. The tube changing device of claim 4, wherein the actuating means comprises a rotor rotatably mounted around the horizontal axis of the fixed plate, the rotor comprising a finger for pushing the tube under the pressurizing means.

8. The tube changing device of claim 7, wherein the finger effects a back-and-forth movement for taking up a tube in the introduction position.

9. The tube changing device of claim 4, wherein a retention means maintains the tube in the introduction position.

10. The tube changing device of claim 4, wherein a retention means maintains the tube in the evacuation position.

11. The tube changing device of claim 4, wherein the guidance means and the actuating means move the tube along a direction around the cylindrical periphery of the fixed plate.

12. The tube changing device of claim 4, wherein the tube plate has a back opposite the cylindrical surface and the pressurizing means transmits radial forces to the back of the plate.

13. The tube changing device of claim 4, wherein a new tube is in the introduction position and a worn tube is in the casting position.

14. The tube changing device of claim 13, wherein the joint between the tube plates of the new tube and the worn tube have edges with nesting contact so that no space exists when the joint is adjacent to the casting orifice of the fixed plate.

15. The tube changing device of claim 4, wherein blocking means prevent rotation of the tube relative to the chassis.

16. A process for replacing a worn tube with a new tube in the continuous casting of steel from a distributor having a refractory plate with a convex cylindrical sliding surface into a mold having a long dimension comprising:

(a) placing the new tube in an introduction position, where the new tube is not in contact with steel in the mold;

(b) moving the worn tube from a casting position to an evacuation position, where the worn tube is not in contact with steel in the mold, by sliding an end of the worn tube against said sliding surface and around a horizontal axis that is perpendicular to the long dimension of the mold and stationary with respect to said distributor; and (c) moving the new tube into the casting position by rotating the new tube around said horizontal axis perpendicular to the long dimension of the mold.

17. The process of claim 16, wherein the new tube pushes the worn tube from the casting position.

18. The process of claim 16, further comprising raising the distributor so that the worn tube avoids contacting the long dimension of the mold and the new tube remains immersed in the steel in the mold.

19. The process of claim 16, further comprising:

(a) placing the new tube in the introduction position essentially parallel to the long dimension of the mold;

(b) rotating the new tube about 90° around the horizontal axis, whereby the worn tube is rotated about 90° to the evacuation position.

20. Tube changing device for a continuous-casting distributor in a steel mill, comprised of:

a chassis mounted on the distributor, refractory pieces that delimit a casting channel for the passage of steel from the distributor to a continuous casting mold with a large dimension and a small dimension, these refractory pieces being comprised of at least one fixed plate and a tube having a plate in its upper part, means for generating pressure for applying the plate of the tube against the fixed plate, a position for introducing a new tube, a casting position and an evacuation position for a worn tube, guidance means that permit the new tube to pass from the introduction position of the casting position and the worn tube to pass from the casting position to the evacuation position, actuating means for moving the new tube from the introduction position to the casting position and the worn tube from the casting position to the evacuation position, characterized in that:

the introduction position, the casting position and the evacuation position are arranged around a convex cylindrical surface that has a horizontal axis (X—X) perpendicular to the large dimension of the mold, this cylindrical surface constituting the periphery of the fixed plate, the plate of the tube has a concave cylindrical form that is adapted to the convex cylindrical surface in order to maintain a tight joint between these surfaces during passage of the new tube from the introduction position to the casting position and the passage of the worn tube from the casting position to the evacuation position by a rotation movement around the axis (X—X) of the cylindrical surface.

21. Device according to claim 20, wherein said mold continuously contains steel, and characterized in that the new tube is entirely out of the steel in the mold when it is in its introduction position, and that the worn tube is entirely out of the steel in the mold when it is in its evacuation position.

22. Device according to claim 20, characterized in that the actuating means are comprised of a rotor, rotatably mounted around the horizontal axis (X—X) of the cylindrical surface, this rotor including a finger that pushes the new tube under the pressurizing means.

23. Device according to claim 22, characterized in that the finger effects a back-and-forth movement for taking up a new tube.

24. Device according to claim 20, characterized in that it has first means of retention that permit maintaining the new tube in its introduction position and second means of retention that permits maintaining the worn tube in its evacuation position.

25. Device according to claim 24, characterized in that the guidance means and the first and second means of retention are designed to permit the introduction of the new tube and evacuation of the worn tube along a direction perpendicular to the large dimension of the mold.

26. Device according to claim 20, characterized in that the means for applying pressure to the plate transmits radial forces to a back of the plate.

27. Device according to claim 20, characterized in that edges of the plates are designed to assure a nesting contact so as not to leave any space between two successive plates during passage of the joint opposite the casting orifice.

28. Device according to claim 20, characterized in that the cylindrical plate has rotational blocking means relative to the chassis.

29. Process for changing a distributor tube for continuous casting in a steel mill for the replacement of a worn tube with a new tube, wherein the steel mill includes a mold that continuously contains steel, and which has a large dimension, comprising the steps of placing a new tube in a tube changing device, then pushing the worn tube with the new tube so that the worn tube is moved from the casting position to an evacuation position, wherein:

the new tube is placed in the tube changing device in a position where the tube is not in contact with the steel in the mold, and the new tube is brought into its casting position by rotating the new tube around a horizontal axis (X—X) that is fixed with respect to said device and perpendicular to the large dimension of the mold, which has the effect of causing the worn tube to rotate around this same axis and bringing it into a position where the tube is not in contact with the steel in the mold and from which it can be extracted from the tube changing device.

30. Process according to claim 29, characterized in that the distributor is raised sufficiently so that an arc that will be described by the end of the new tube and of the worn tube avoids an edge of the mold, but without the tube in the process of casting ceasing to be immersed in the molten steel of the mold.

31. Process according to claim 29, characterized in that the new tube is placed in the tube changing device in an essentially horizontal position, the new tube is brought into its casting position by an essentially 90° rotation around the horizontal axis (X—X), which has the effect of rotating the worn tube essentially 90° around the horizontal axis (X—X); and in that the worn tube is extracted out of the tube changing device in an essentially horizontal position.

32. Device according to claim 20, wherein said tube plate is integrally formed on said tube.

33. Refractory pieces for use in the continuous casting of steel that delimit a casting channel for the passage of the steel comprising:

(a) a refractory tube having a first end, a second end, a throughbore opening extending from the first end to the second end, and a tube plate surrounding the first end of the tube, the tube plate having a concave annular surface, and (b) a refractory plate having a convex annular periphery for slidably mating with the tube plate and a casting orifice aligned with the throughbore opening.

34. Process according to claim 16, wherein said old tube engages said new tube in nesting contact.

* * * * *